US010437275B2

(12) United States Patent
Shin

(10) Patent No.: US 10,437,275 B2
(45) **Date of Patent: *Oct. 8, 2019**

(54) CURRENT REFERENCE CIRCUIT AND SEMICONDUCTOR INTEGRATED CIRCUIT INCLUDING THE SAME

(71) Applicant: SAMSUNG ELECTRONICS CO., LTD., Suwon-si, Gyeonggi-do (KR)

(72) Inventor: Ho-Young Shin, Gunpo-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/995,189

(22) Filed: Jun. 1, 2018

(65) Prior Publication Data

US 2018/0284831 A1 Oct. 4, 2018

Related U.S. Application Data

(63) Continuation of application No. 15/236,502, filed on Aug. 15, 2016, now Pat. No. 9,996,100.

(30) Foreign Application Priority Data

Sep. 15, 2015 (KR) ..... 10-2015-0130600

(51) Int. Cl.
*G05F 3/24* (2006.01)
*G05F 3/26* (2006.01)

(52) U.S. Cl.
CPC ..... *G05F 3/242* (2013.01); *G05F 3/262* (2013.01); *G05F 3/245* (2013.01)

(58) Field of Classification Search
CPC . G05F 3/24; G05F 3/242; G05F 3/245; G05F 3/262
See application file for complete search history.

(56) References Cited

U.S. PATENT DOCUMENTS 6,260,081 B1 7/2001 Magro et al.
6,472,858 B1 * 10/2002 Tanase ..... G05F 3/262 323/315

(Continued)

FOREIGN PATENT DOCUMENTS

JP 2014048764 3/2014
KR 1020120116708 A 10/2012
KR 1020150003087 A 1/2015

OTHER PUBLICATIONS

Zhao et al., Chen, "A Compact Low-Power Supply-Insensitive CMOS Current Reference,".

(Continued)

*Primary Examiner* — Fred E Finch, III
(74) *Attorney, Agent, or Firm* — Volentine, Whitt & Francos, PLLC

(57) ABSTRACT

A current reference circuit and a semiconductor IC including the current reference circuit, the current reference circuit including a proportional to absolute temperature (PTAT) current generator configured to generate, in an output branch, a first current proportional to a temperature; and a current subtractor configured to generate a reference current by subtracting a second current generated based on a current flowing in an internal branch of the PTAT current generator, from the first current flowing in the output branch. The second current is set to have a same temperature-based change characteristic as the first current and a level different from a level of the first current.

20 Claims, 14 Drawing Sheets

(56) References Cited

U.S. PATENT DOCUMENTS

| | | | | |
|---|---|---|---|---|
| 7,248,099 | B2 | 7/2007 | Kedilaya et al. | |
| 7,388,787 | B2 | 6/2008 | Portmann et al. | |
| 7,589,580 | B2 | 9/2009 | Lee et al. | |
| 7,595,685 | B1 * | 9/2009 | Sakurai | G05F 3/262 327/513 |
| 7,638,996 | B2 | 12/2009 | Sugimura et al. | |
| 7,710,096 | B2 | 5/2010 | Kotchkine et al. | |
| 7,737,675 | B2 | 6/2010 | Murase | |
| 7,965,476 | B2 | 6/2011 | Mizuno | |
| 8,305,134 | B2 | 11/2012 | Hirose et al. | |
| 8,441,246 | B2 | 5/2013 | Hong | |
| 8,797,094 | B1 * | 8/2014 | Washburn | G05F 1/561 323/313 |
| 9,234,804 | B2 | 1/2016 | Englasyam | |
| 9,395,740 | B2 | 7/2016 | Pavao-Moreira | |
| 9,519,304 | B1 * | 12/2016 | Far | G05F 3/262 |
| 9,996,100 | B2 * | 6/2018 | Shin | G05F 3/262 |
| 2002/0109490 | A1 * | 8/2002 | Engl | G05F 3/262 323/312 |
| 2006/0006858 | A1 * | 1/2006 | Chiu | G05F 3/262 323/313 |
| 2006/0125547 | A1 * | 6/2006 | Maymandi-Nejad | G05F 3/262 327/512 |
| 2006/0176041 | A1 * | 8/2006 | Pletersek | G05F 3/245 323/312 |
| 2007/0176591 | A1 * | 8/2007 | Kimura | G05F 3/245 323/315 |
| 2009/0066313 | A1 * | 3/2009 | Kimura | G05F 3/262 323/313 |
| 2010/0225384 | A1 | 9/2010 | Hirose et al. | |
| 2011/0043185 | A1 | 2/2011 | Kim | |
| 2011/0050198 | A1 | 3/2011 | Dong et al. | |
| 2011/0193544 | A1 | 8/2011 | Iacob et al. | |
| 2012/0007659 | A1 | 1/2012 | Cusinato | |
| 2012/0025801 | A1 | 2/2012 | Hirose et al. | |
| 2012/0218026 | A1 | 8/2012 | Niadimpalli et al. | |
| 2012/0293238 | A1 | 11/2012 | Chen | |
| 2013/0272341 | A1 | 10/2013 | Lee et al. | |
| 2014/0111480 | A1 | 4/2014 | Kim et al. | |
| 2014/0266137 | A1 | 9/2014 | Jang et al. | |
| 2016/0357212 | A1 * | 12/2016 | Horng | G05F 3/245 |
| 2018/0017986 | A1 * | 1/2018 | Lahiri | G05F 3/262 |
| 2018/0032097 | A1 * | 2/2018 | Liou | G05F 3/262 |

OTHER PUBLICATIONS

Fiori, Franco, "A New Compact Temperature-Compensated CMOS Current Reference," IEEE Transactions on Circuits and Systems-II: Express Briefs, vol. 52, No. 11, Nov. 2005, pp. 724-728.

Zhe et al., Zhao, "All-CMOS Temperature Compensated Current Reference," Journal of Semiconductors, Vo. 31, No. 6, Jun. 2010, pp. 065016-1-065016-4.

* cited by examiner

CURRENT REFERENCE CIRCUIT AND SEMICONDUCTOR INTEGRATED CIRCUIT INCLUDING THE SAME

CROSS-REFERENCE TO RELATED APPLICATION

This is a Continuation of U.S. application Ser. No. 15/236,502, filed Aug. 15, 2016, now U.S. Pat. No. 9,996,100 issued on Jun. 12, 2018, in which a claim of priority under 35 U.S.C. § 119 is made to Korean Patent Application No. 10-2015-0130600, filed on Sep. 15, 2015, in the Korean Intellectual Property Office, the entire contents of which are hereby incorporated by reference.

BACKGROUND

The present inventive concept herein relates to a power supply circuit of a semiconductor integrated circuit (IC) and an operation method thereof, and more particularly, to a current reference circuit and a semiconductor IC including the same.

Current reference circuits may be used in semiconductor ICs to generate a reference current having the characteristic of a proportional to absolute temperature (PTAT) current where the reference current increases in proportion to a temperature change. The reference current may be used as a bias current by circuits in the semiconductor IC. However, when the reference current increases in proportion to a temperature, operating currents of all circuits using the reference current as a bias current increase in proportion to an increase in a temperature. If the number of circuits using the reference current increases, consumption power increases to more than a designed value at a high temperature.

SUMMARY

Embodiments of the inventive concept provide a current reference circuit that generates a constant current irrespective of a temperature change.

Embodiments of the inventive concept provide a semiconductor IC including a current reference circuit that generates a constant current irrespective of a temperature change.

According to embodiments of the inventive concept, there is provided a current reference circuit including a proportional to absolute temperature (PTAT) current generator configured to generate, in an output branch, a first current proportional to a temperature; and a current subtractor configured to generate a reference current by subtracting a second current generated based on a current flowing in an internal branch of the PTAT current generator, from the first current flowing in the output branch. The second current is set to have a same temperature-based change characteristic as the first current and a level different from a level of the first current.

According to embodiments of the inventive concept, there is provided a semiconductor integrated circuit including a current reference circuit configured to generate a first proportional to absolute temperature (PTAT) current and a second PTAT current using a PTAT current generator, and to generate a reference current based on a difference between the first PTAT current and the second PTAT current. The first PTAT current and the second PTAT current have the same temperature change rate and different levels. The semiconductor integrated circuit further includes a voltage reference circuit configured to generate a reference voltage based on the reference current, and a peripheral device configured to operate an internal circuit with the reference voltage.

According to embodiments of the inventive concept, there is provided a current reference circuit including a proportional to absolute temperature (PTAT) current generator including a plurality of branch circuits including a first branch circuit, a second branch circuit and an output branch circuit, each of the plurality of branch circuits configured to generate a first current proportional to a temperature; and a current subtractor configured to mirror the first current flowing through the second branch circuit to generate a second current having a same temperature characteristic and a level different than the first current, and to generate a reference current by subtracting the second current from the first current generated by the output branch circuit. The first branch circuit includes a resistor configured to set a current level of the first current.

BRIEF DESCRIPTION OF THE DRAWINGS

Embodiments of the inventive concept will be more clearly understood from the following detailed description taken in conjunction with the accompanying drawings in which.

DETAILED DESCRIPTION OF THE EMBODIMENTS

Figure 1:
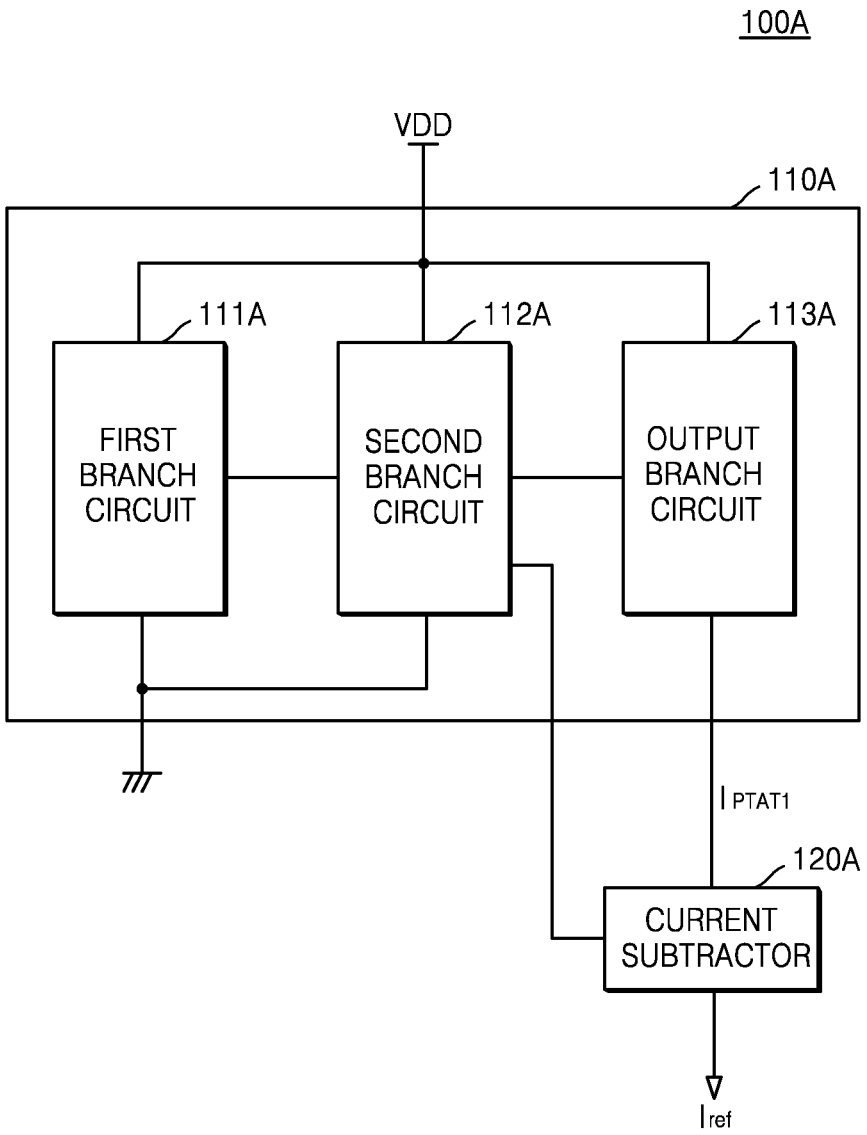
FIG. 1 illustrates an example of a configuration of a current reference circuit according to an embodiment of the inventive concept.

Hereinafter, example embodiments of the inventive concept will be described in detail with reference to the accompanying drawings. Embodiments of the inventive concept are provided so that this disclosure will be thorough and complete, and will fully convey the concept of the inventive concept to one of ordinary skill in the art. Since the inventive concept may have diverse modified embodiments, preferred embodiments are illustrated in the drawings and are described in the detailed description of the inventive concept. However, this description should not limit the inventive concept within specific embodiments and it should be understood that the inventive concept covers all the modifications, equivalents, and replacements within the idea and technical scope of the inventive concept. Like reference numerals refer to like elements throughout. In the drawings, the dimensions and size of each structure may be exaggerated, reduced, or schematically illustrated for convenience in description and clarity.

The terms used in this application, wherein only certain embodiments have been described, are not intended to limit the present embodiments. In the following description, the technical terms are used only to explain specific embodiments while not limiting the present embodiments. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

Unless otherwise defined, all terms (including technical and scientific terms) used herein have the same meaning as commonly understood by one of ordinary skill in the art to which this inventive concept belongs. It should be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term "and/or" includes any and all combinations of one or more of the associated listed items. Expressions such as "at least one of" when preceding a list of elements, modify the entire list of elements and do not modify the individual elements of the list.

As is traditional in the field of the inventive concepts, embodiments may be described and illustrated in terms of blocks which carry out a described function or functions. These blocks, which may be referred to herein as units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and/or software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the inventive concepts. Likewise, the blocks of the embodiments may be physically combined into more complex blocks without departing from the scope of the inventive concepts.

FIG. 1 illustrates an example of a configuration of a current reference circuit 100A according to an embodiment of the inventive concept.

Referring to FIG. 1, the current reference circuit 100A includes a proportional to absolute temperature (PTAT) current generator 110A and a current subtractor 120A. The PTAT current generator 110A includes a first branch circuit 111A, a second branch circuit 112A, and an output branch circuit 113A. For example, the same source voltage VDD may be supplied to the first branch circuit 111A, the second branch circuit 112A, and the output branch circuit 113A.

The PTAT current generator 110A generates a current $I_{PTAT1}$ proportional to a temperature, and the generated current $I_{PTAT1}$ is applied to the current subtractor 120A through the output branch circuit 113A. For example, the current $I_{PTAT1}$ may have a characteristic where the current $I_{PTAT1}$ increases in proportion to a change in an absolute temperature.

The first branch circuit 111A is coupled to the second branch circuit 112A, and taken together the first and second branch circuits 111A and 112A may form one or more current mirror circuits. The first branch circuit 111A and the second branch circuit 112A may each include one or more transistors. For example, the first branch circuit 111A and the second branch circuit 112A may each include one or more metal oxide semiconductor (MOS) transistors. For example, the first branch circuit 111A and the second branch circuit 112A may each include a PMOS transistor and an NMOS transistor. A self-bias circuit may be implemented through wiring-processing one of the PMOS transistors and the NMOS transistors included in the first branch circuit 111A and the second branch circuit 112A into the configuration of a diode element. Also, a resistor for adjusting or setting a current level of the current $I_{PTAT1}$ may be included in one of the first branch circuit 111A and the second branch circuit 112A.

The current $I_{PTAT1}$ proportional to a temperature flows through a branch of each of the first branch circuit 111A and the second branch circuit 112A, based on an effective channel length change characteristic of a transistor included in each of the first branch circuit 111A and the second branch circuit 112A with respect to a temperature change.

The output branch circuit 113A is coupled to the first branch circuit 111A and the second branch circuit 112A, and taken together the output branch circuit 113A and the first and second branch circuits 111A and 112A form one or more current mirror circuits. If transistors of the output branch circuit 113A, the first branch circuit 111A, and the second branch circuit 112A configuring the current mirror circuit are designed to have the same size, a current flowing through a branch of the output branch circuit 113A may be the same as the current $I_{PTAT1}$ flowing through a branch of each of the first branch circuit 111A and the second branch circuit 112A. The size of the transistors as mentioned may denote a channel size of the transistor. That is, the channel size of a transistor may be determined based on a channel length "L" and a channel width "W" of the transistor.

The current subtractor 120A generates a current $I_{PTAT2}$, based on a current flowing in an internal branch of the PTAT current generator 110A. For example, the current subtractor 120A may generate the current $I_{PTAT2}$ as a copy of a current flowing in a branch of the second branch circuit 112A by using a current mirror circuit. In this case, the generated current $I_{PTAT2}$ may have the same change characteristic of a current with respect to a temperature and have a different level from the current flowing in the branch of the second branch circuit 112A. For example, an aspect ratio of a transistor that is in the current subtractor 120A and that forms a current mirror circuit along with a transistor in a branch of the second branch circuit 112A, may be adjusted or set to generate the current $I_{PTAT2}$ which has the same temperature-based change characteristic as the current $I_{PTAT1}$ flowing in the branch of the second branch circuit 112A and which has a level different from that of the current $I_{PTAT1}$.

The current subtractor 120A generates a reference current $I_{ref}$ by subtracting the current $I_{PTAT2}$ from the current $I_{PTAT1}$ flowing in a branch of the output branch circuit 113A. Therefore, the reference current $I_{ref}$ may have characteristic insensitive to a temperature.

Figure 2:
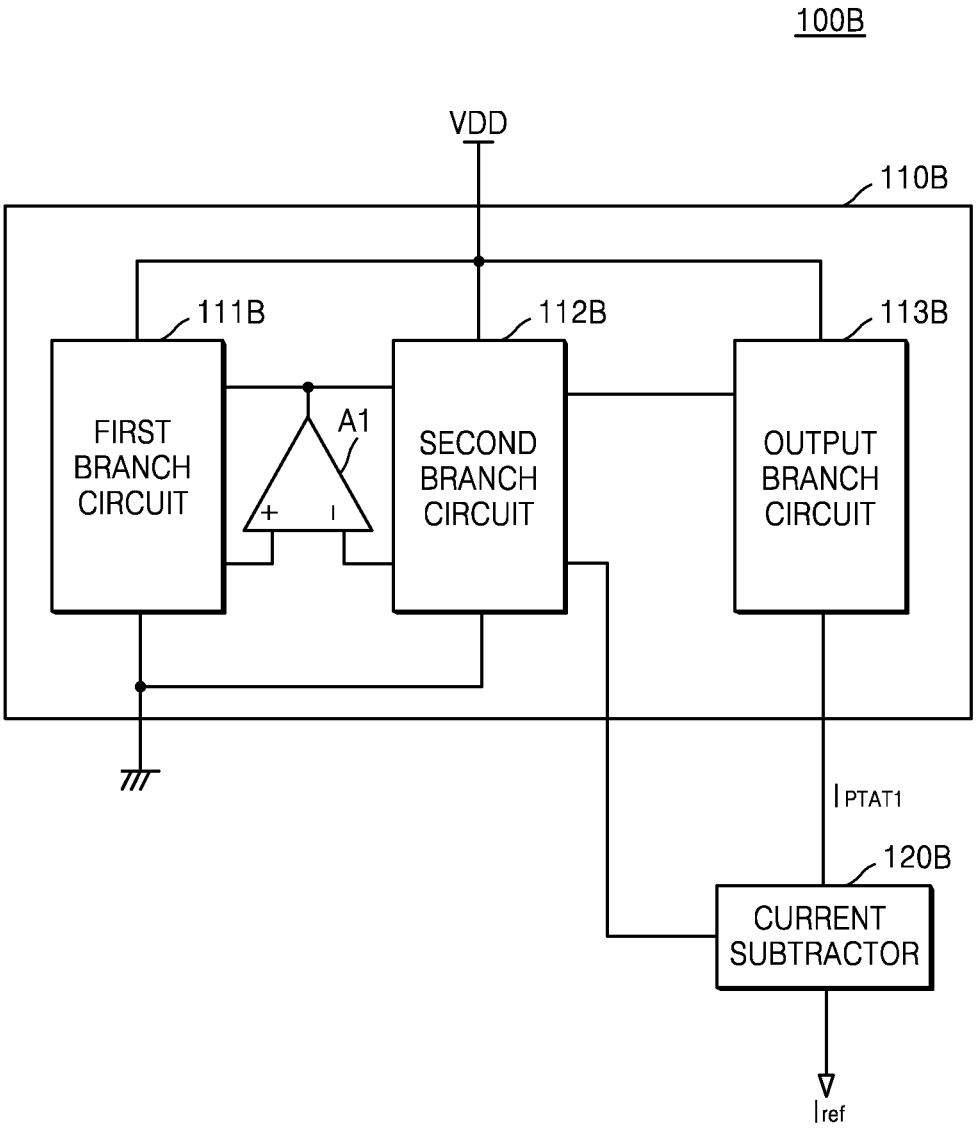
FIG. 2 illustrates another example of a configuration of a current reference circuit according to an embodiment of the inventive concept.

FIG. 2 illustrates another example of a configuration of a current reference circuit 100B according to an embodiment of the inventive concept.

Referring to FIG. 2, the current reference circuit 100B includes a PTAT current generator 110B and a current subtractor 120B. The PTAT current generator 110B includes a first branch circuit 111B, a second branch circuit 112B, an output branch circuit 113B, and an amplifier A1. For example, the same source voltage VDD may be supplied to the first branch circuit 111B, the second branch circuit 112B, and the output branch circuit 113B.

The source voltage VDD applied to the current reference circuit 100B may be set to have a voltage level lower than that of the source voltage VDD applied to the current reference circuit 100A.

The PTAT current generator 110B generates a current $I_{PTAT1}$ proportional to a temperature, and the generated current $I_{PTAT1}$ is applied to the current subtractor 120B through the output branch circuit 113B. For example, the current $I_{PTAT1}$ may have characteristic where the current $I_{PTAT1}$ increases in proportion to a change in an absolute temperature.

The first branch circuit 111B is coupled to the second branch circuit 112B, and taken together the first and second branch circuits 111B and 112B may form one or more current mirror circuits. The first branch circuit 111B and the second branch circuit 112B may each include one or more transistors. For example, the first branch circuit 111B and the second branch circuit 112B may each include one or more MOS transistors. For example, the first branch circuit 111B and the second branch circuit 112B may each include a PMOS transistor and an NMOS transistor. A self-bias circuit may be implemented through wiring-processing of one of the PMOS transistors and the NMOS transistors included in the first branch circuit 111B and the second branch circuit 112B into the configuration of a diode element. Also, a resistor for adjusting a current level of the current $I_{PTAT1}$ may be included in one of the first branch circuit 111B and the second branch circuit 112B.

The current $I_{PTAT1}$ proportional to a temperature flows through a branch of each of the first branch circuit 111B and the second branch circuit 112B, based on an effective channel length change characteristic of a transistor included in each of the first branch circuit 111B and the second branch circuit 112B with respect to a temperature change.

The amplifier A1 amplifies a voltage difference between a node of the branch of the first branch circuit 111B and a node of the branch of the second branch circuit 112B to supply a voltage, obtained through the amplification, to a current mirror circuit configured by the first branch circuit 111B and the second branch circuit 112B. That is, an output voltage of the amplifier A1 is applied to a gate terminal of each of transistors included in a current mirror circuit configured by the first branch circuit 111B, the second branch circuit 112B, and the output branch circuit 113B. Therefore, the transistors included in the current mirror circuit configured by the first branch circuit 111B, the second branch circuit 112B, and the output branch circuit 113B may be controlled in common by the output voltage of the amplifier A1.

The output branch circuit 113B is coupled to the first branch circuit 111B and the second branch circuit 112B, and taken together the output branch circuit 113B and the first and second branch circuits 111B and 112B form one or more current mirror circuits. If transistors of the output branch circuit 113B, the first branch circuit 111B, and the second branch circuit 112B configuring the current mirror circuit are designed to have the same size, a current flowing through a branch of the output branch circuit 113B may be the same as the current $I_{PTAT1}$ flowing through a branch of each of the first branch circuit 111B and the second branch circuit 112B. The size of the transistors as mentioned may denote a channel size of the transistor. That is, the channel size of a transistor may be determined based on a channel length "L" and a channel width "W" of the transistor.

The current subtractor 120B generates a current $I_{PTAT2}$, based on a current flowing in an internal branch of the PTAT current generator 110B. For example, the current subtractor 120B may generate the current $I_{PTAT2}$ as a copy of a current flowing in a branch of the second branch circuit 112B by using a current mirror circuit. In this case, the generated current $I_{PTAT2}$ may have the same change characteristic of a current with respect to a temperature and have a different level from the current flowing in the branch of the second branch circuit 112B. For example, an aspect ratio of a transistor that is in the current subtractor 120B and that forms a current mirror circuit along with a transistor in a branch of the second branch circuit 112B, may be adjusted to generate the current $I_{PTAT2}$ which has the same temperature-based change characteristic as the current $I_{PTAT1}$ flowing in the branch of the second branch circuit 112B and which has a level different from that of the current $I_{PTAT1}$.

The current subtractor 120B generates a reference current $I_{ref}$ by subtracting the current $I_{PTAT2}$ from the current $I_{PTAT1}$ flowing in a branch of the output branch circuit 113B. Therefore, the reference current $I_{ref}$ may have characteristic insensitive to a temperature.

Figure 3:
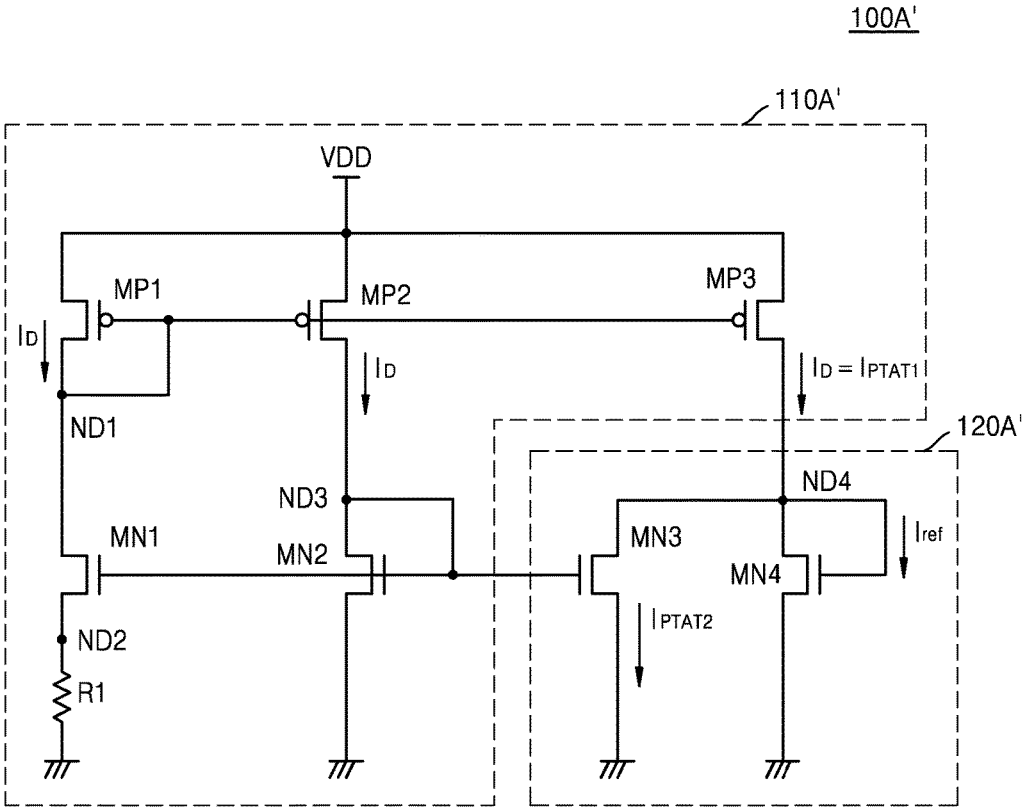
FIG. 3 illustrates an example of a circuit configuration of the current reference circuit illustrated in FIG. 1.

FIG. 3 illustrates an example 100A' of a circuit configuration of the current reference circuit illustrated in FIG. 1.

Referring to FIG. 3, the current reference circuit 100A' includes a PTAT current generator 110A' and a current subtractor 120A'.

The PTAT current generator 110A' includes a plurality of PMOS transistors MP1 to MP3 and a plurality of NMOS transistors MN1 and MN2 and a resistor R1.

A first branch circuit is configured by the PMOS transistor MP1, the NMOS transistor MN1, and the resistor R1. In detail, a source terminal of the PMOS transistor MP1 is connected to a source voltage terminal, and a gate terminal and a drain terminal of the PMOS transistor MP1 are connected to a node ND1. A drain terminal of the NMOS transistor MN1 is connected to the node ND1, a source terminal of the NMOS transistor MN1 is connected to a node ND2, and a gate terminal of the NMOS transistor MN1 is connected to a node ND3. Also, the resistor R1 is connected between the node ND2 and a ground terminal. Since the gate terminal and drain terminal of the PMOS transistor MP1 are connected to each other, the PMOS transistor MP1 is configured and operates as a diode.

A second branch circuit is configured by the PMOS transistor MP2 and the NMOS transistor MN2. In detail, a source terminal of the PMOS transistor MP2 is connected to the source voltage terminal, a drain terminal of the PMOS transistor MP2 is connected to the node ND3, and a gate terminal of the PMOS transistor MP2 is connected to the node ND1. A gate terminal and a drain terminal of the NMOS transistor MN2 are connected to the node ND3, and a source terminal of the NMOS transistor MN2 is connected to the ground terminal. Since the gate terminal and drain terminal of the NMOS transistor MN2 are connected to each other, the NMOS transistor MN2 is configured and operates as a diode.

An output branch circuit is configured by the PMOS transistor MP3. In detail, a source terminal of the PMOS transistor MP3 is connected to the source voltage terminal, a drain terminal of the PMOS transistor MP3 is connected to the node ND4, and a gate terminal of the PMOS transistor MP3 is connected to the node ND1.

The gate terminals of the PMOS transistors MP1 to MP3 are connected to the node ND1 in common, and the source terminals of the PMOS transistors MP1 to MP3 are connected to the source voltage terminal in common. That is, gate-source voltages of the PMOS transistors MP1 to MP3 are the same. For example, channel sizes of the PMOS transistors MP1 to MP3 may be identically designed. Therefore, source-drain currents $I_D$ of the PMOS transistors MP1 to MP3 are the same. That is, the PMOS transistors MP1 to MP3 taken together from a current mirror circuit.

The NMOS transistors MN1 and MN2 as taken together form a current mirror circuit. A ratio of a channel size of the NMOS transistor MN2 to a channel size of the NMOS transistor MN1 may be set to 1:n (where n is a natural number). For example, the channel sizes of all the NMOS transistors of the PTAT current generator 110A' may be identically designed, and n number of NMOS transistors may be connected in parallel between the node ND1 and the node ND2 identically to a connection type of the NMOS transistor MN1.

A current $I_{PTAT1}$ which is changed in proportion to a temperature flows between a source terminal and a drain terminal of each of the PMOS transistors MP1 to MP3 of the PTAT current generator 110A', based on an effective channel length change characteristic of each of the PMOS transistors MP1 to MP3 or the NMOS transistors MN1 to MN2 with respect to a temperature change. That is, the same current $I_{PTAT1}$ may flow in a first branch, a second branch, and an output branch of the PTAT current generator 110A'.

The current subtractor 120A' includes two NMOS transistors MN3 and MN4. In detail, a drain terminal of the NMOS transistor MN3 is connected to a node ND4, a source terminal of the NMOS transistor MN3 is connected to the ground terminal, and a gate terminal of the NMOS transistor MN3 is connected to the node ND3 of the second branch of the PTAT current generator 110A'. Also, a gate terminal and a drain terminal of the NMOS transistor MN4 is connected to the node ND4, and a source terminal of the NMOS transistor MN4 is connected to the ground terminal.

The NMOS transistor MN3 of the current subtractor 120A' and the NMOS transistor MN2 of the PTAT current generator 110A' taken together form a current mirror circuit. In this case, an aspect ratio of the NMOS transistor MN3 may be set differently than an aspect ratio of the NMOS transistor MN2. For example, an aspect ratio of the NMOS transistor MN3 may be determined and set so that a drain-source current of the NMOS transistor MN2 and a drain-source current of the NMOS transistor MN3 have the same temperature change rate and different levels.

Therefore, a current $I_{PTAT2}$ which is the drain-source current of the NMOS transistor MN3 and the current $I_{PTAT1}$ which is the drain-source current of the NMOS transistor MN2 may have the same temperature change rate but may have different levels. Also, as described above, due to the current mirror circuit, the current $I_{PTAT1}$ which is the drain-source current of the NMOS transistor MN2 may be the same as the drain-source current of the PMOS transistor MP3 of the output branch of the PTAT current generator 110A'.

Figure 6B:
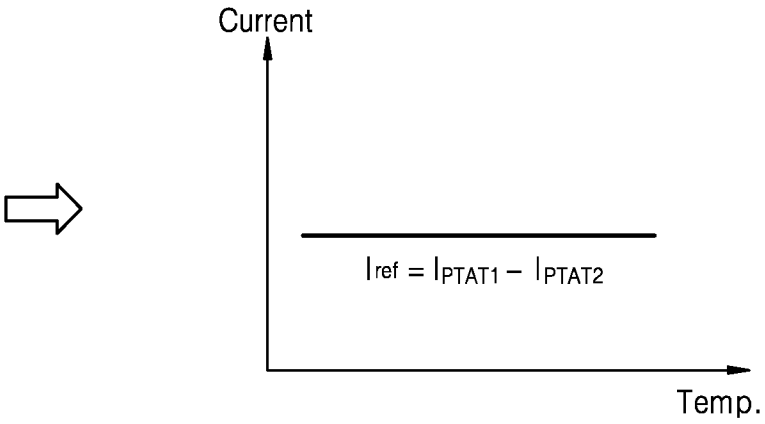
FIGS. 6A and 6B illustrate diagrams showing the principle of generating a reference current insensitive to a temperature change, according to an embodiment of the inventive concept.
Figure 6A:
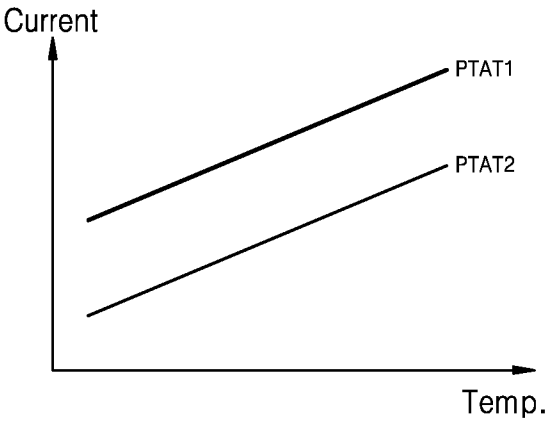

Therefore, the current $I_{PTAT1}$ of the output branch of PTAT current generator 110A' and the current $I_{PTAT2}$ of a first sub-branch of the current subtractor 120A' branching from the node ND4 of the output branch may be shown as in FIG. 6A. Therefore, the reference current $I_{ref}$ that is a current of a second sub-branch of the current subtractor 120A' branching from the node ND4 of the output branch is a current obtained by subtracting the current $I_{PTAT2}$ of the first sub-branch from the current $I_{PTAT1}$ of the output branch. That is, the reference current $I_{ref}$ may be shown as in FIG. 6B. As shown in FIG. 6B, it may be seen that the reference current $I_{ref}$ has characteristic insensitive to a temperature change.

Figure 4:
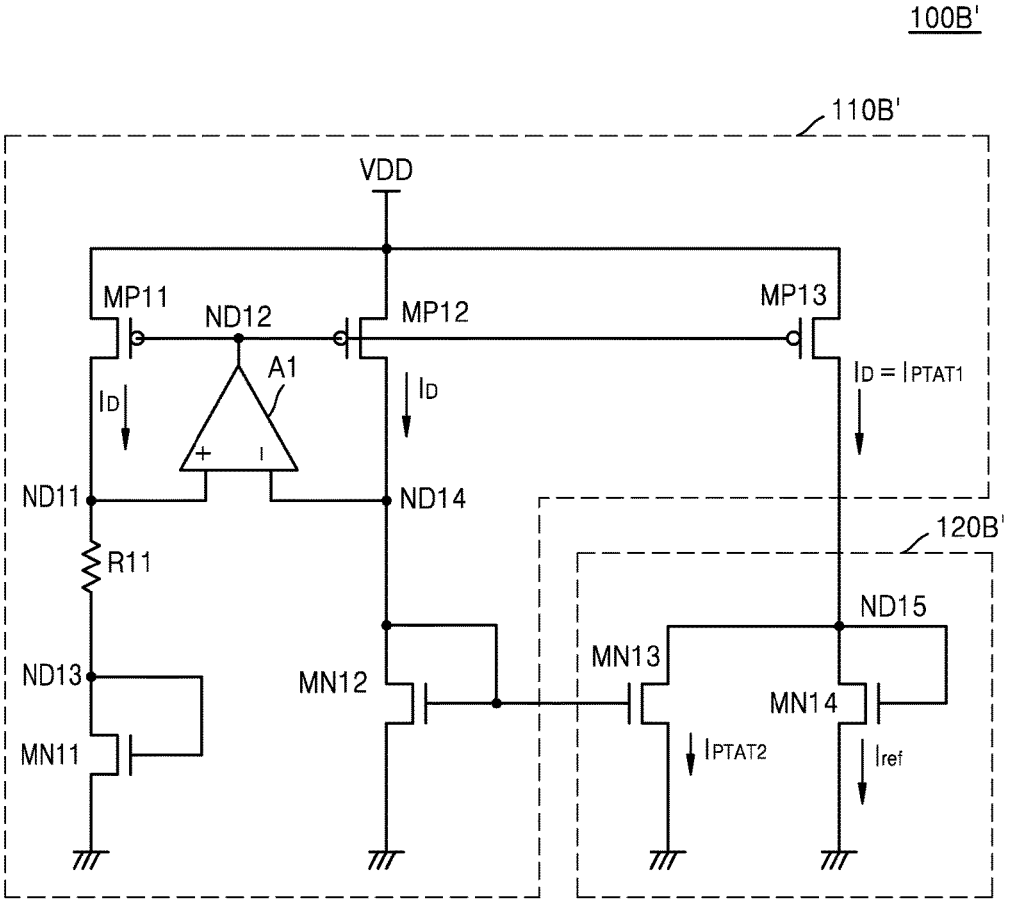
FIG. 4 illustrates an example of a circuit configuration of the current reference circuit illustrated in FIG. 2.

FIG. 4 illustrates an example 100B' of a circuit configuration of the current reference circuit illustrated in FIG. 2.

Referring to FIG. 4, a current reference circuit 100B' includes a PTAT current generator 110B' and a current subtractor 120B'.

The PTAT current generator 110B' includes a plurality of PMOS transistors MP11 to MP13 and a plurality of NMOS transistors MN11 and MN12, a resistor R11, and an amplifier A1.

A first branch circuit is configured by the PMOS transistor MP11, the NMOS transistor MN11, and the resistor R11. In detail, a source terminal of the PMOS transistor MP11 is connected to a source voltage terminal, a drain terminal of the PMOS transistor MP11 is connected to a node ND11, and a gate terminal of the PMOS transistor MP11 is connected to a node ND12. The resistor R11 is connected between the node ND11 and a node ND13. A gate terminal and a drain terminal of the NMOS transistor MN11 are connected to the node ND13, and a source terminal of the NMOS transistor MN11 is connected to a ground terminal. Since the gate terminal and drain terminal of the NMOS transistor MN11 are connected to each other, the NMOS transistor MN11 is configured and operates as a diode.

A second branch circuit is configured by the PMOS transistor MP12 and the NMOS transistor MN12. In detail, a source terminal of the PMOS transistor MP12 is connected to the source voltage terminal, a drain terminal of the PMOS transistor MP12 is connected to a node ND14, and a gate terminal of the PMOS transistor MP12 is connected to the node ND12. A gate terminal and a drain terminal of the NMOS transistor MN12 are connected to the node ND14, and a source terminal of the NMOS transistor MN12 is connected to the ground terminal. Since the gate terminal and drain terminal of the NMOS transistor MN12 are connected to each other, the NMOS transistor MN12 is configured and operates as a diode.

A first input terminal of the amplifier A1 is connected to the node ND11, a second input terminal of the amplifier A1 is connected to the node ND14, and an output terminal of the amplifier A1 is connected to the node ND12. For example, the first input terminal may be set as a positive (+) input terminal, and the second input terminal may be set as a negative (−) input terminal. As another example, the first input terminal may be set as a negative (−) input terminal, and the second input terminal may be set as a positive (+) input terminal.

The amplifier A1 amplifies a voltage difference between the node ND11 of the first branch and the node ND14 of the second branch to supply an output voltage, obtained through the amplification, to the node ND12. Therefore, an output voltage of the amplifier A1 is applied to a gate terminal of each of the PMOS transistors MP11 and MP12 which taken together form a current mirror circuit. That is, a source-drain current of each of the PMOS transistors MP11 and MP12 forming the current mirror circuit may be controlled by the output voltage of the amplifier A1.

An output branch circuit is configured by the PMOS transistor MP13. In detail, a source terminal of the PMOS transistor MP13 is connected to the source voltage terminal, a drain terminal of the PMOS transistor MP13 is connected to a node ND15, and a gate terminal of the PMOS transistor MP13 is connected to the node ND12.

The gate terminals of the PMOS transistors MP11 to MP13 are connected to the node ND12 in common, and the source terminals of the PMOS transistors MP11 to MP13 are connected to the source voltage terminal in common. That is, gate-source voltages of the PMOS transistors MP11 to MP13 are the same. For example, channel sizes of the PMOS transistors MP11 to MP13 are identically designed. Therefore, source-drain currents $I_D$ of the PMOS transistors MP11 to MP13 are the same. That is, the PMOS transistors MP11 to MP13 taken together form a current mirror circuit.

A ratio of a channel size of the NMOS transistor MN12 included in the second branch to a channel size of the NMOS transistor MN11 included in the first branch may be set to 1:n (where n is a natural number). For example, the channel size of all the NMOS transistors of the PTAT current generator 110B' may be identically designed, and n number of NMOS transistors may be connected in parallel between the node ND13 and the ground terminal identically to a connection type of the NMOS transistor MN11.

A current $I_{PTAT1}$ which is changed in proportion to a temperature flows between a source terminal and a drain terminal of each of the PMOS transistors MP11 to MP13 of the PTAT current generator 110B', based on an effective channel length change characteristic of each of the PMOS transistors MP11 to MP13 or the NMOS transistors MN11 to MN12 with respect to a temperature change. That is, the same current $I_{PTAT1}$ may flow in the first branch, second branch, and output branch of the PTAT current generator 110B'.

The current subtractor 120B' includes two NMOS transistors MN13 and MN14. In detail, a drain terminal of the NMOS transistor MN13 is connected to the node ND15, a source terminal of the NMOS transistor MN13 is connected to the ground terminal, and a gate terminal of the NMOS transistor MN13 is connected to the node ND14 of the second branch of the PTAT current generator 110B'. Also, a gate terminal and a drain terminal of the NMOS transistor MN14 are connected to the node ND15, and a source terminal of the NMOS transistor MN14 is connected to the ground terminal.

The NMOS transistor MN13 of the current subtractor 120B' and the NMOS transistor MN12 of the PTAT current generator 110B' taken together from a current mirror circuit. In this case, an aspect ratio of the NMOS transistor MN13 may be set differently than an aspect ratio of the NMOS transistor MN12. For example, an aspect ratio of the NMOS transistor MN13 may be determined and set so that a drain-source current of the NMOS transistor MN12 and a drain-source current of the NMOS transistor MN13 have the same temperature change rate and different levels.

Therefore, a current $I_{PTAT2}$ which is the drain-source current of the NMOS transistor MN13 and the current $I_{PTAT1}$ which is the drain-source current of the NMOS transistor MN12 may have the same temperature change rate but may have different levels. Also, as described above, due to the current mirror circuit, the current $I_{PTAT1}$ which is the drain-source current of the NMOS transistor MN12 may be the same as the drain-source current of the PMOS transistor MP13 of the output branch of the PTAT current generator 110B'.

Therefore, the current $I_{PTAT1}$ of the output branch of the PTAT current generator 110B' and the current $I_{PTAT2}$ of a first sub-branch of the current subtractor 120B' branching from the node ND15 of the output branch may be shown as in FIG. 6A. Therefore, the reference current $I_{ref}$ that is a current of a second sub-branch of the current subtractor 120B' branching from the node ND15 of the output branch may be a current obtained by subtracting the current $I_{PTAT2}$ of the first sub-branch from the current $I_{PTAT1}$ of the output branch. That is, the reference current $I_{ref}$ may be shown as in FIG. 6B. As shown in FIG. 6B, it may be seen that the reference current $I_{ref}$ has characteristic insensitive to a temperature change.

Figure 5:
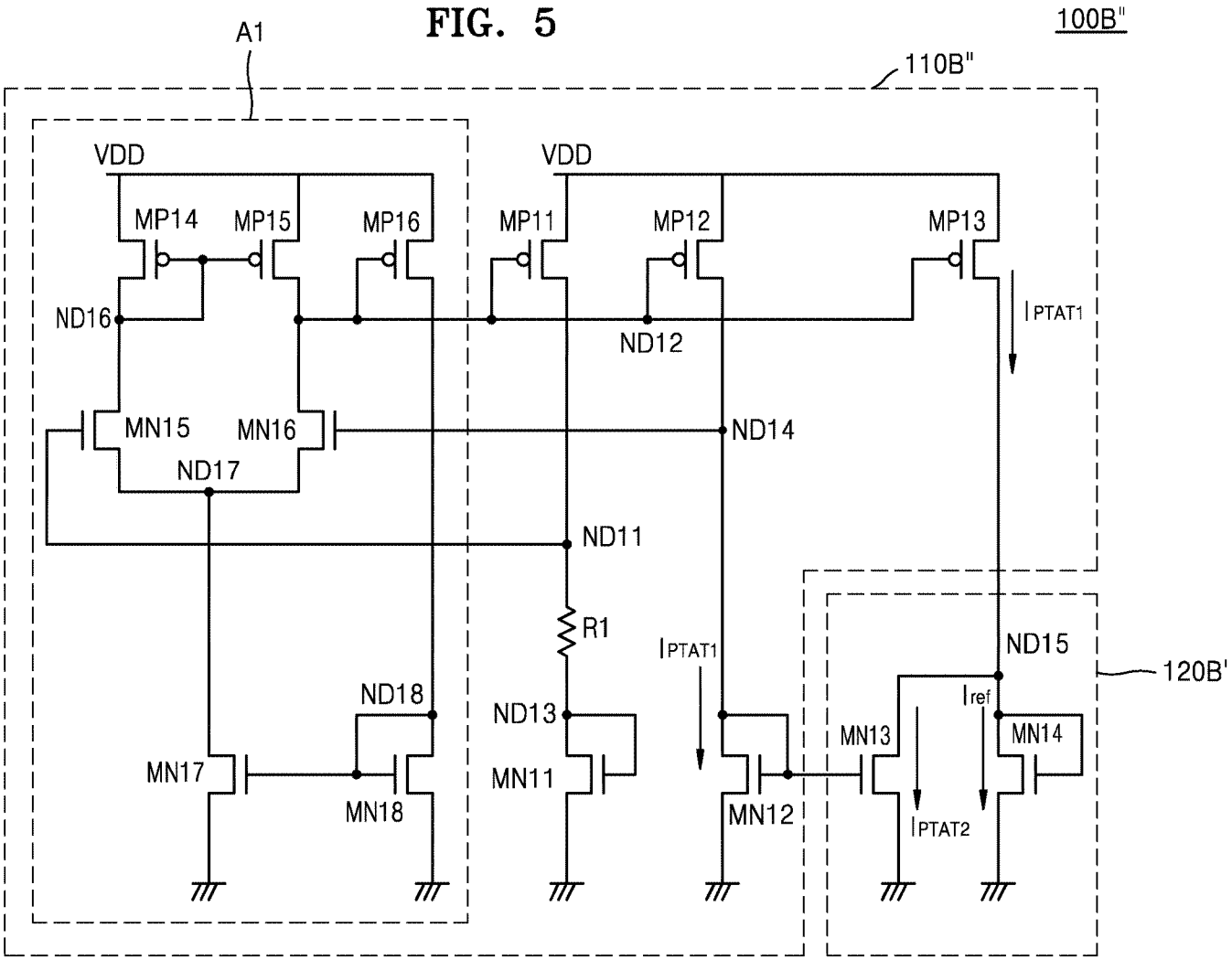
FIG. 5 illustrates an example of a detailed circuit configuration of the current reference circuit illustrated in FIG. 2.

FIG. 5 illustrates an example 100B" of a detailed circuit configuration of the current reference circuit illustrated in FIG. 2. For reference, FIG. 5 is a circuit illustrating in detail the amplifier A1 of the current reference circuit 100B' illustrated in FIG. 4. The following description of FIG. 5 will focus on the circuit of amplifier A1 of PTAT current generator 110B", and description of other components of FIG. 5 having the same configuration and function as corresponding components in FIG. 4 may be omitted for the sake of brevity.

As shown in FIG. 5, amplifier A1 includes a plurality of PMOS transistors MP14 to MP16 and a plurality of NMOS transistors MN15 to MN18.

In detail, a source terminal of the PMOS transistor MP14 is connected to a source voltage terminal, and a gate terminal and a drain terminal of the PMOS transistor MP14 are connected to a node ND16. A source terminal of the PMOS transistor MP15 is connected to the source voltage terminal, a drain terminal of the PMOS transistor MP15 is connected to a node ND12, and a gate terminal of the PMOS transistor MP15 is connected to the node ND16. A source terminal of the PMOS transistor MP16 is connected to the source voltage terminal, a drain terminal of the PMOS transistor MP16 is connected to a node ND18, and a gate terminal of the PMOS transistor MP16 is connected to the node ND12.

Moreover, a drain terminal of the NMOS transistor MN15 is connected to a node ND16, a source terminal of the NMOS transistor MN15 is connected to a node ND17, and a gate terminal of the NMOS transistor MN15 is connected to a node ND11. A drain terminal of the NMOS transistor MN16 is connected to the node ND12, a source terminal of the NMOS transistor MN16 is connected to the node ND17, and a gate terminal of the NMOS transistor MN16 is connected to a node ND14. A drain terminal of the NMOS transistor MN17 is connected to the node ND17, a source terminal of the NMOS transistor MN17 is connected to a ground terminal, and a gate terminal of the NMOS transistor MN17 is connected to the node ND18. A gate terminal and a drain terminal of the NMOS transistor MN18 are connected to the node ND18 in common, and a source terminal of the NMOS transistor MN18 is connected to the ground terminal.

The amplifier A1 operates as a differential amplifier. A voltage of the node ND11 of a first branch and a voltage of the node ND14 of a second branch are respectively applied to the gate terminal of the NMOS transistor MN15 and the gate terminal of the NMOS transistor MN16 which respectively correspond to two input terminals of the differential amplifier.

Therefore, the amplifier A1 amplifies a difference between the voltage of the node ND11 of the first branch and the voltage of the node ND14 of the second branch and applies an output voltage, obtained through the amplification, to the node ND12. That is, a source-drain current of each of the PMOS transistors MP11 and MP12 configuring the current mirror circuit of the PTAT current generator 110B" may be controlled by the output voltage of the amplifier A1.

A method of generating, by the current reference circuit 100A', 100B' or 100B" of FIGS. 3 to 5, a reference current insensitive to a temperature will be described below in detail. Hereinafter, for convenience of description, a description will be made with reference to the current reference circuit 100B' of FIG. 4.

FIGS. 6A and 6B illustrate diagrams showing the principle of generating a reference current insensitive to a temperature change, according to an embodiment of the inventive concept.

As shown in FIG. 6A, a current $I_{PTAT1}$ (shown in FIG. 6A as PTAT1) which is generated by each of the internal branches and the output branch due to the current mirror circuit of the PTAT current generator 110B' may have characteristic where a current increases in proportion to a temperature change.

Moreover, the NMOS transistor MN13 of the sub-branch where a current $I_{PTAT2}$ (shown in FIG. 6A as PTAT2) flows and the NMOS transistor MN12 of the PTAT current generator 110B' taken together from a current mirror circuit. In this case, a channel length of the NMOS transistor MN13 may be set shorter than a channel length of the NMOS transistor MN12. Also, if an aspect ratio of the NMOS transistor MN13 is determined and set so that the drain-source current of the NMOS transistor MN12 and the drain-source current of the NMOS transistor MN13 have the same temperature change rate and different levels, the current $I_{PTAT2}$ may be shown as in FIG. 6A.

That is, as shown in FIG. 6A, in the above noted case the current $I_{PTAT2}$ is lower in level than the current $I_{PTAT1}$, but the current $I_{PTAT1}$ and the current $I_{PTAT2}$ have the same current change rate with respect to temperature. Therefore, by subtracting the current $I_{PTAT2}$ of the first sub-branch from the current $I_{PTAT1}$ of the output branch in the current subtractor 120B', the reference current $I_{ref}$ may have characteristic insensitive to a temperature change as shown in FIG. 6B.

Figure 7:
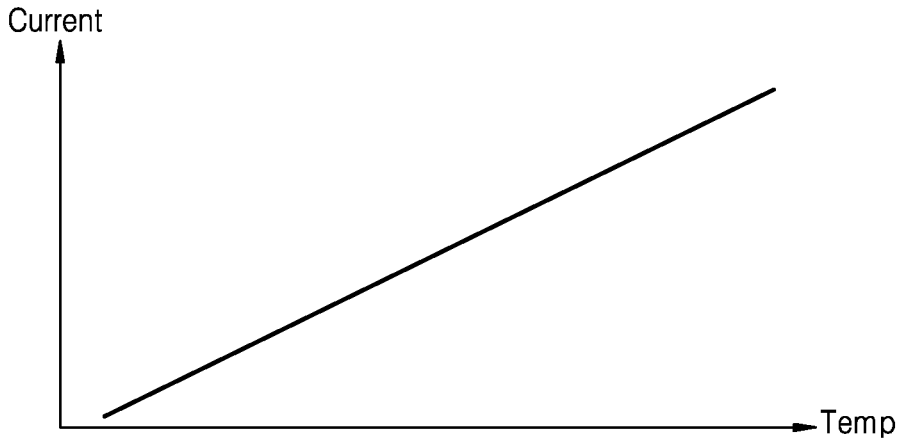
FIG. 7 illustrates a diagram showing a current change characteristic where a current of each of PMOS transistors included in a PTAT current generator of FIGS. 3 and 4 is changed with respect to a temperature change.

FIG. 7 illustrates a diagram showing a current change characteristic where a current of each of PMOS transistors included in the PTAT current generator 110A' and the PTAT current generator 110B' of FIGS. 3 and 4 is changed with respect to a temperature change.

For example, FIG. 7 shows a temperature change characteristic of a source-drain current of each of the NMOS transistor MN13 and the PMOS transistors MP12 and MP13 configuring the current mirror circuit of the PTAT current generator 110B' of FIG. 4. It may be seen that a current has a characteristic of linearly increasing according to a change in a temperature.

Figure 8:
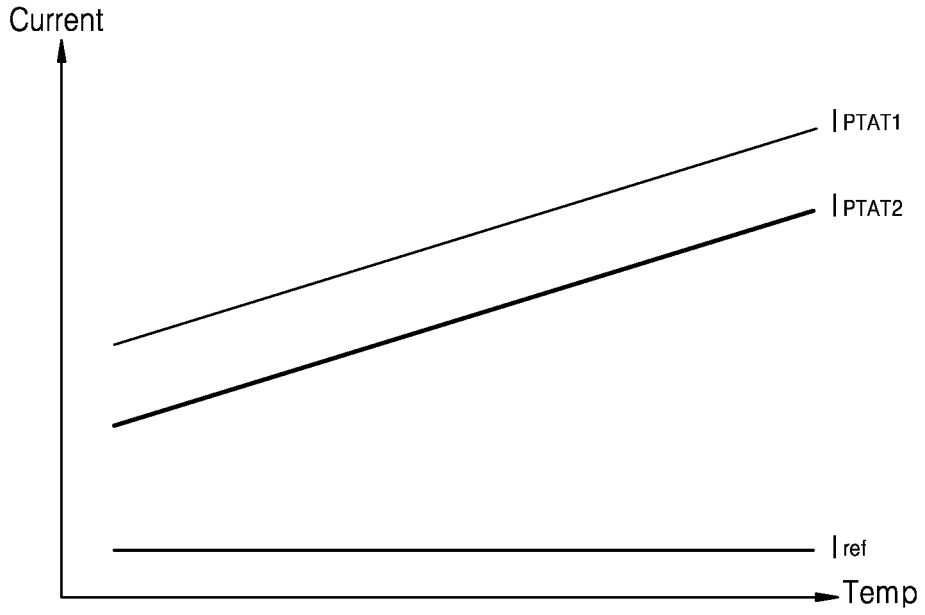
FIG. 8 illustrates a diagram showing a current change characteristic where a current $I_{PTAT1}$, a current $I_{PTAT2}$, and a current $I_{ref}$ which flow in branches of the current reference circuit of FIGS. 3 and 4 are changed with respect to a temperature change.

FIG. 8 illustrates a diagram showing a current change characteristic where a current $I_{PTAT1}$, a current $I_{PTAT2}$, and a reference current $I_{ref}$ which flow in branches of the current reference circuit of FIGS. 3 and 4 are changed with respect to a temperature change.

For example, FIG. 8 shows a current change characteristic of each of the current $I_{PTAT1}$ flowing in the output branch of the PTAT current generator 110B' of FIG. 4, the current $I_{PTAT2}$ flowing in the first sub-branch branching from the output branch, and the reference current $I_{ref}$ flowing in the second sub-branch branching from the output branch, with respect to a temperature change. As shown in FIG. 8, the reference current $I_{ref}$ has a characteristic insensitive to a temperature change.

Figure 9A:
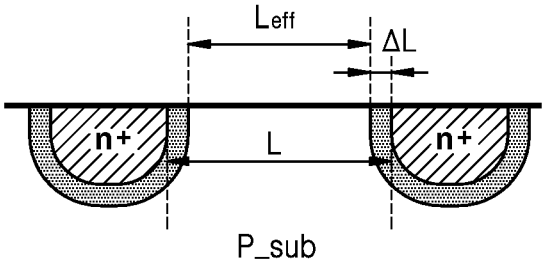
FIGS. 9A and 9B illustrate diagrams exemplarily showing a change in an effective channel length of an NMOS transistor applied to a current reference circuit according to embodiments of the inventive concept with respect to a temperature change.
Figure 9A:
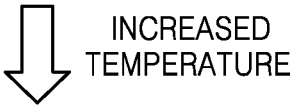
Figure 9B:
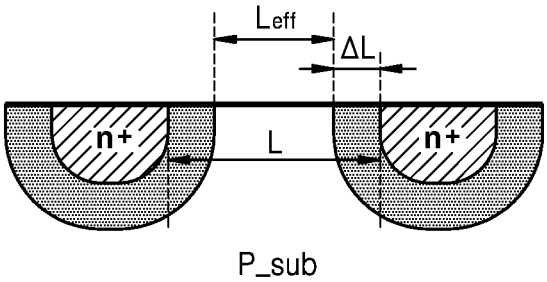

FIGS. 9A and 9B illustrate diagrams exemplarily showing a change in an effective channel length of an NMOS transistor used in a current reference circuit according to an embodiment of the inventive concept, with respect to a temperature change.

In FIG. 9A, L denotes a channel length, ΔL denotes a depletion region, and $L_{eff}$ denotes an effective channel length. As a temperature increases, a depletion region of the NMOS transistor increases. Therefore, when a temperature increases, as shown in FIG. 9B, the effective channel length "$L_{eff}$" is reduced in comparison with FIG. 9A.

In the NMOS transistor, if the channel length "L" is small, a rate at which the effective channel length "$L_{eff}$" is reduced according to an increase in temperature may increase. Therefore, a slope of an increased current based on a temperature change may increase. That is, the amount of increase of a current is higher at a high temperature than the amount of increase of a current at a low temperature.

For reference, the current $I_D$ flowing in each of the branches of the PTAT current generator 110B' of FIG. 4 may be expressed as the following Equation (1):

$$I_D \propto \left[\frac{1}{R_o^2} * \frac{(\sqrt{n}-1)^2}{n} * \frac{2}{C_{ox} * \frac{Dk}{q} * \frac{W_2}{L_2}}\right] * T \tag{1}$$

where $R_0$ denotes a resistance value of the resistor R11, n denotes a ratio of a channel size of the NMOS transistor MN11 to a channel size of the NMOS transistor MN12, $C_{ox}$ denotes a capacitance value of a gate oxide layer of the NMOS transistor MN12, D denotes a diffusion coefficient, K denotes Boltzmann constant, q denotes a charge amount value of a channel, L2 denotes a channel length of the NMOS transistor MN12, W2 denotes a channel width of the NMOS transistor MN12, and T denotes an absolute temperature.

As described above, a channel length of the NMOS transistor MN13 included in the current subtractor 120B' may be designed shorter than that of the NMOS transistor MN12 included in the PTAT current generator 110B'. Therefore, when mirroring a current flowing in the NMOS transistor MN12 by using the NMOS transistor MN13, a change rate of a current with respect to a temperature change may be changed according to an aspect ratio "W/L" of a transistor.

In Equation (1), if factors other than the absolute temperature "T" and an aspect ratio "$W_2/L_2$" of the NMOS transistor MN12 are expressed as one variable "Z", the current $I_{PTAT1}$ may be expressed as the following Equation (2), and the current $I_{PTAT2}$ may be expressed as the following Equation (3):

$$I_{PTAT1} = Z * \frac{L_2}{W_2} * T \tag{2}$$

$$I_{PTAT2} = Z * \left[\frac{W_3/L_{3eff}}{W_2/L_{2eff}}\right] * T * I_{PTAT1} = Z * \left[\frac{W_3 * (L_2 - T * 2\Delta L_2)}{W_2 * (L_3 - T * 2\Delta L_3)}\right] * T * I_{PTAT1} \tag{3}$$

where $L_3$ denotes a channel length of the NMOS transistor MN13, $W_3$ denotes a channel width of the NMOS transistor MN13, $L_{2eff}$ denotes an effective channel length of the NMOS transistor MN12, $L_{3eff}$ denotes an effective channel length of the NMOS transistor MN13, $\Delta L_2$ denotes a length of a depletion region of the NMOS transistor MN12, and $\Delta L_3$ denotes a length of a depletion region of the NMOS transistor MN13.

When a temperature increases, the depletion region of the NMOS transistor MN12 and the depletion region of the NMOS transistor MN13 are broadened, and thus, an effective channel length is reduced. In the NMOS transistor MN13 having a relatively short channel length, when a depletion region is reduced by $\Delta L$, a reduction rate of an effective channel length increases in comparison with the NMOS transistor MN12. With this principle, when a channel length of the NMOS transistor MN13 is adjusted, a slope of a changed current with respect to a temperature may be adjusted.

That is, since an aspect ratio of the NMOS transistor MN12 and an aspect ratio of the NMOS transistor MN13 are differently designed, a current $I_{PTAT2}$ where a slope of a changed current with respect to a temperature change is the same as a current $I_{PTAT1}$ and which has a level different from that of the current $I_{PTAT1}$ may be generated, and a reference current $I_{ref}$ irrelevant to a temperature may be generated by subtracting the current $I_{PTAT2}$ from the current $I_{PTAT1}$.

Figure 10B:
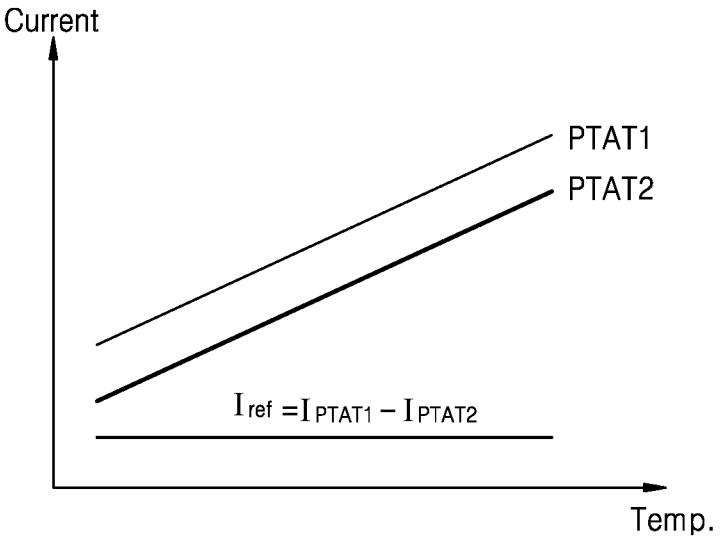
FIGS. 10A and 10B illustrate diagrams showing the principle of determining an aspect ratio of an NMOS transistor included in a branch generating a current $I_{PTAT2}$ of a current subtractor illustrated in FIGS. 3 and 4.
Figure 10A:
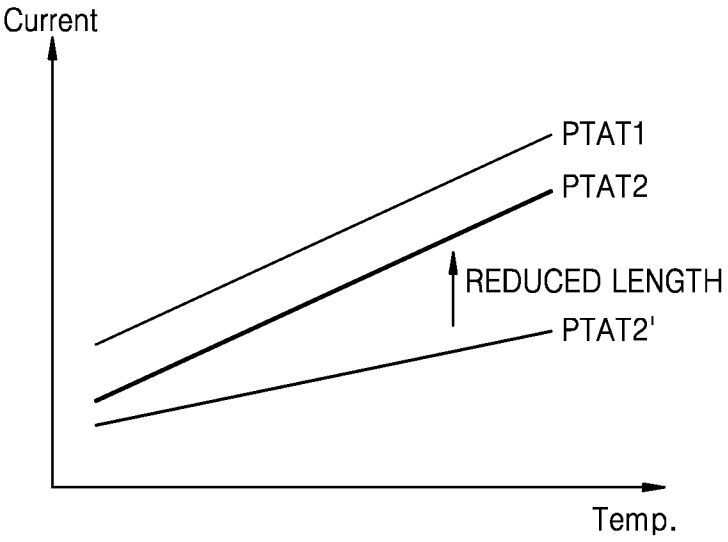

FIGS. 10A and 10B illustrate diagrams showing the principle of determining an aspect ratio of an NMOS transistor included in a branch generating the current $I_{PTAT2}$ of the current subtractor illustrated in FIGS. 3 and 4.

In FIG. 10A, when a channel length of the NMOS transistor MN13 is designed identically to that of the NMOS transistor MN12 and only a channel width of the NMOS transistor MN13 is reduced in comparison with the NMOS transistor MN12, a characteristic of a current $I_{PTAT2}$ with respect to a temperature is shown as PTAT2'.

However, when only a channel width of the NMOS transistor MN13 is reduced, a level of a current is reduced in comparison with a current $I_{PTAT1}$ (shown in FIG. 10A as PTAT1), and a slope of the changed current (shown in FIG. 10A as PTAT2') with respect to a temperature is reduced in comparison with the current $I_{PTAT1}$. When a channel length of the NMOS transistor MN13 is then reduced, a level of a current increases, and a slope of a changed current with respect to a temperature increases.

Therefore, only a channel width of the NMOS transistor MN13 is reduced, and then, when a channel length of the NMOS transistor MN13 is adjusted to be reduced, a characteristic of the current $I_{PTAT2}$ (shown in FIG. 10A as PTAT2) with respect to a temperature is obtained.

For example, an aspect ratio "$W_3/L_3$" of the NMOS transistor MN13 having a characteristic of the current $I_{PTAT2}$ (shown in FIG. 10A as PTAT2) with respect to a temperature may be determined through simulation in a product designing stage.

By applying the determined aspect ratio "$W_3/L_3$" of the NMOS transistor MN13, the current reference circuit 100B' may generate a reference current $I_{ref}$ irrelevant to a temperature as shown in FIG. 10B.

Figure 11:
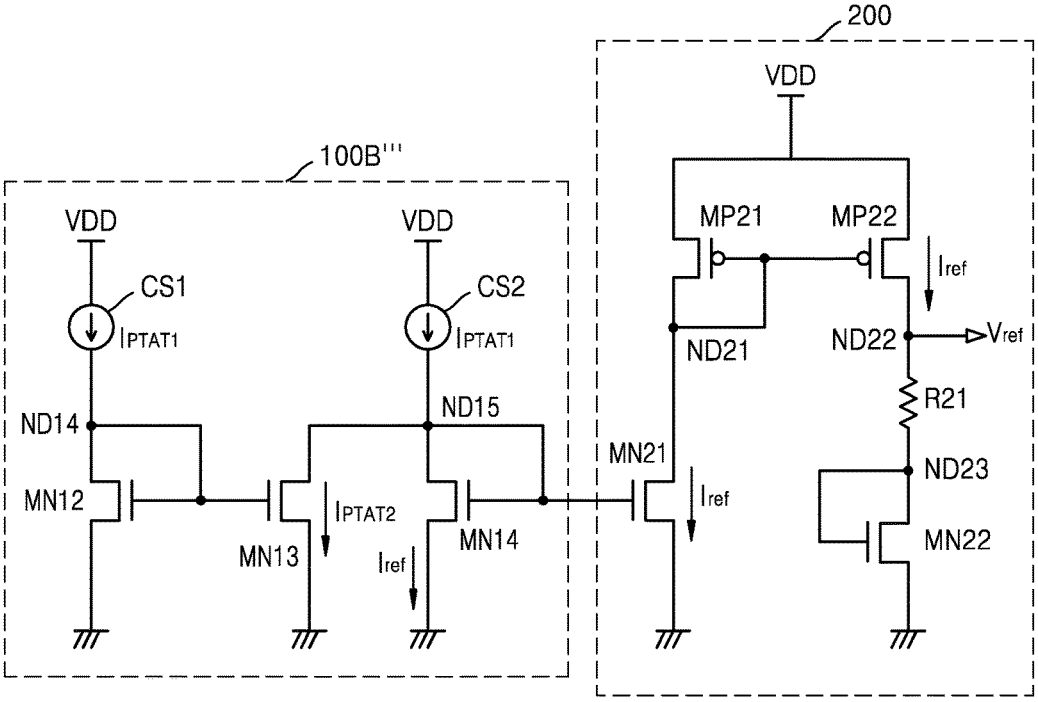
FIG. 11 illustrates a configuration of a voltage reference circuit to which a current reference circuit according to embodiments of the inventive concept is applied.

FIG. 11 illustrates a configuration of a voltage reference circuit to which a current reference circuit according to an embodiment of the inventive concept is applied.

Referring to FIG. 11, reference numeral "100B'''" refers to an equivalent circuit of the current reference circuit 100B' of FIG. 4, and reference numeral "200" refers to a voltage reference circuit.

In FIG. 11, current sources CS1 and CS2 may equivalently express a current $I_{PTAT1}$ flowing in the internal branches of the PTAT current generator 110B' of FIG. 4. In FIG. 4, as described above, a reference current $I_{ref}$ insensitive to a temperature may flow in a drain-source of an NMOS transistor MN14.

The voltage reference circuit 200 includes two PMOS transistors MP21 and MP22, two NMOS transistors MN21 and MN22, and a resistor R21. In detail, a source terminal of the PMOS transistor MP21 is connected to a source voltage terminal, and a gate terminal and a drain terminal of the PMOS transistor MP21 are connected to a node ND21 in common. A source terminal of the PMOS transistor MP22 is connected to the source voltage terminal, a drain terminal of the PMOS transistor MP22 is connected to a node ND22, and a gate terminal of the PMOS transistor MP22 is connected to the node ND21. Also, a drain terminal of the NMOS transistor MN21 is connected to the node ND21, a source terminal of the NMOS transistor MN21 is connected to a ground terminal, and a gate terminal of the NMOS transistor MN21 is connected to a node ND15. A gate terminal and a drain terminal of the NMOS transistor MN22 is connected to a node ND23, and a source terminal of the NMOS transistor MN22 is connected to the ground terminal. The resistor R21 is connected between the node ND22 and the node ND23.

The NMOS transistor MN21 is coupled to the NMOS transistor MN14 of the current reference circuit 100B'''', and taken together the NMOS transistors MN21 and MN14 form a current mirror circuit. If a channel size of the NMOS transistor MN21 and a channel size of the NMOS transistor MN14 are identically designed, a drain-source current of the NMOS transistor MN21 may be copied as a reference current $I_{ref}$.

Moreover, the PMOS transistors MP21 and MP22 as taken together form a current mirror circuit. Therefore, if channel sizes of the PMOS transistors MP21 and MP22 are identically designed, a drain-source current of the PMOS transistor MP22 may be copied as the reference current $I_{ref}$. Therefore, a reference voltage Vref based on the reference current $I_{ref}$ may be generated in the node ND22.

Figure 12:
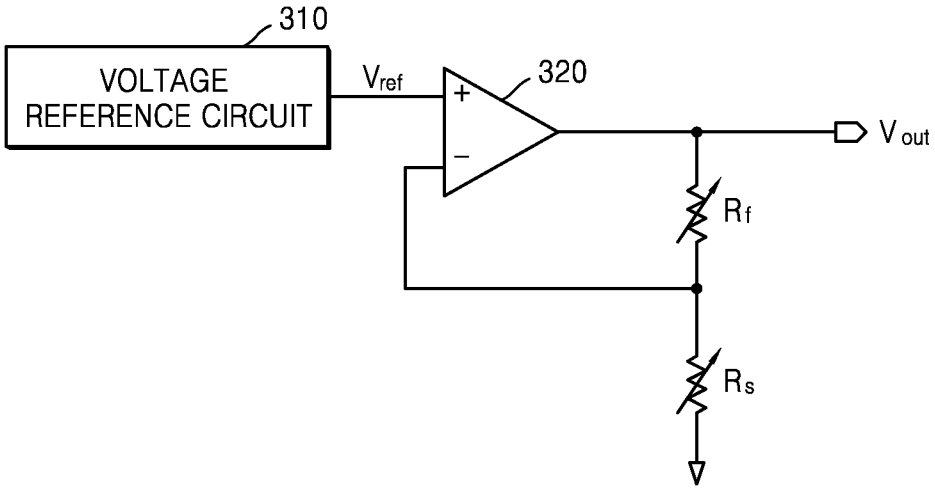
FIG. 12 illustrates a configuration of a voltage regulator circuit to which a current reference circuit according to embodiments of the inventive concept is applied.

FIG. 12 illustrates a configuration of a voltage regulator circuit to which a current reference circuit according to an embodiment of the inventive concept is applied.

Referring to FIG. 12, the voltage regulator circuit includes a voltage reference circuit 310, an amplifier 320, and a plurality of resistors $R_f$ and $R_s$.

The voltage reference circuit 310 may use, for example, a voltage reference circuit including the current reference circuit illustrated in FIG. 11.

An output voltage $V_{out}$ generated by the amplifier 320 may be expressed as the following Equation (4):

$$V_{out}=V_{ref}(1+R_f/R_s) \quad (4)$$

Therefore, the output voltage $V_{out}$ having a desired voltage level may be generated by adjusting resistance values of the resistors $R_f$ and $R_s$.

Figure 13:
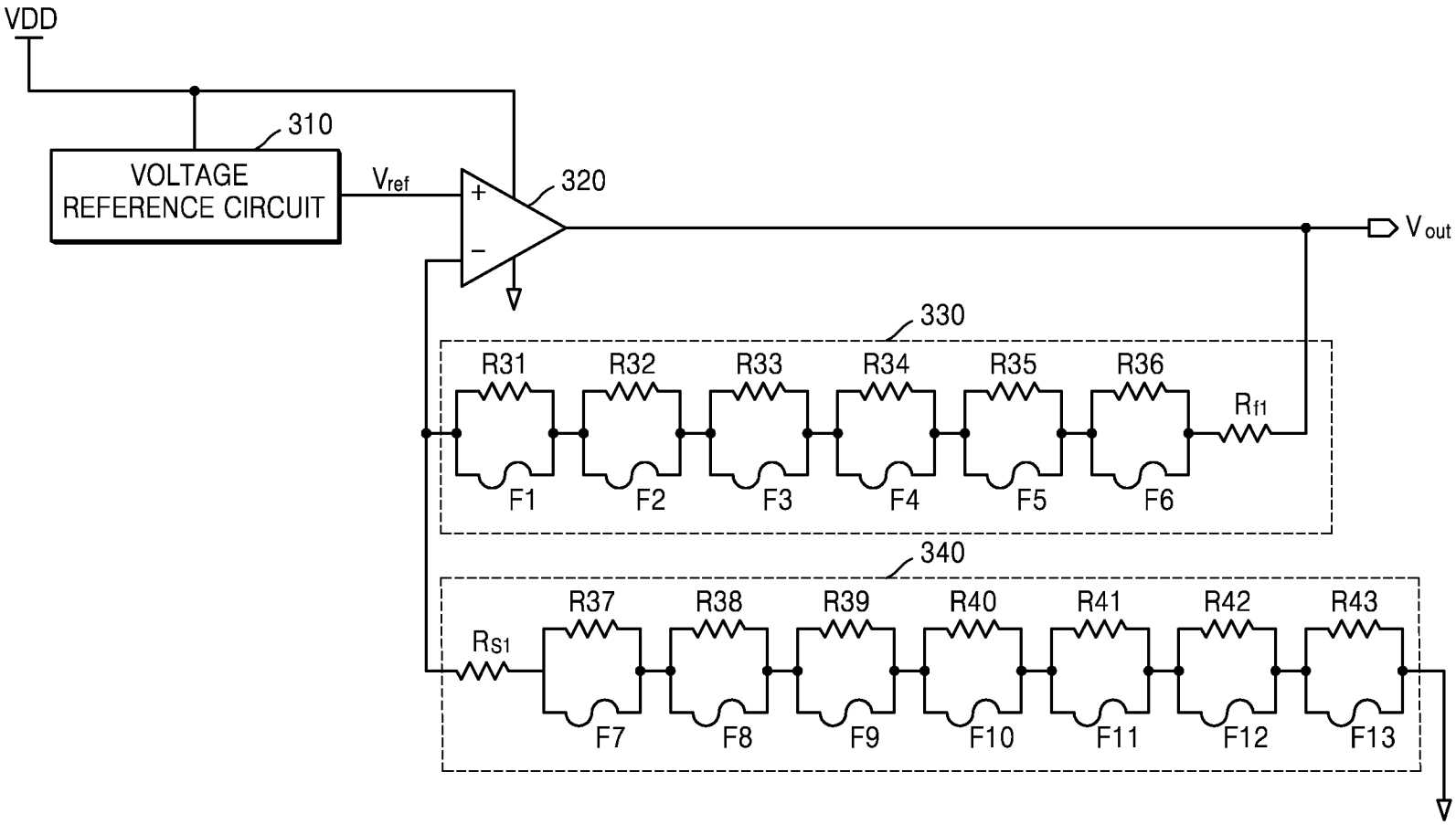
FIG. 13 illustrates a detailed configuration of the voltage regulator circuit illustrated in FIG. 12.

FIG. 13 illustrates a detailed configuration of the voltage regulator circuit illustrated in FIG. 12.

In FIG. 13, reference numeral "330" refers to an example where the resistor $R_f$ of FIG. 12 is implemented by using a plurality of fusing elements F1 to F6 and a plurality of resistors $R_n$ and R31 to R36. Also, reference numeral "340" refers to an example where the resistor $R_s$ of FIG. 12 is implemented by using a plurality of fusing elements F7 to F13 and a plurality of resistors $R_{s1}$ and R37 to R43.

As illustrated in FIG. 13, a resistance value of the resistor $R_f$ of FIG. 12 may be adjusted by selectively performing a fusing on/off operation on the plurality of fusing elements F1 to F6. In this way, a resistance value of the resistor $R_s$ of FIG. 12 may be adjusted by selectively performing the fusing on/off operation on the plurality of fusing elements F7 to F13. Therefore, the output voltage $V_{out}$ having a desired voltage level may be generated by using the plurality of fusing elements F1 to F13.

Figure 14:
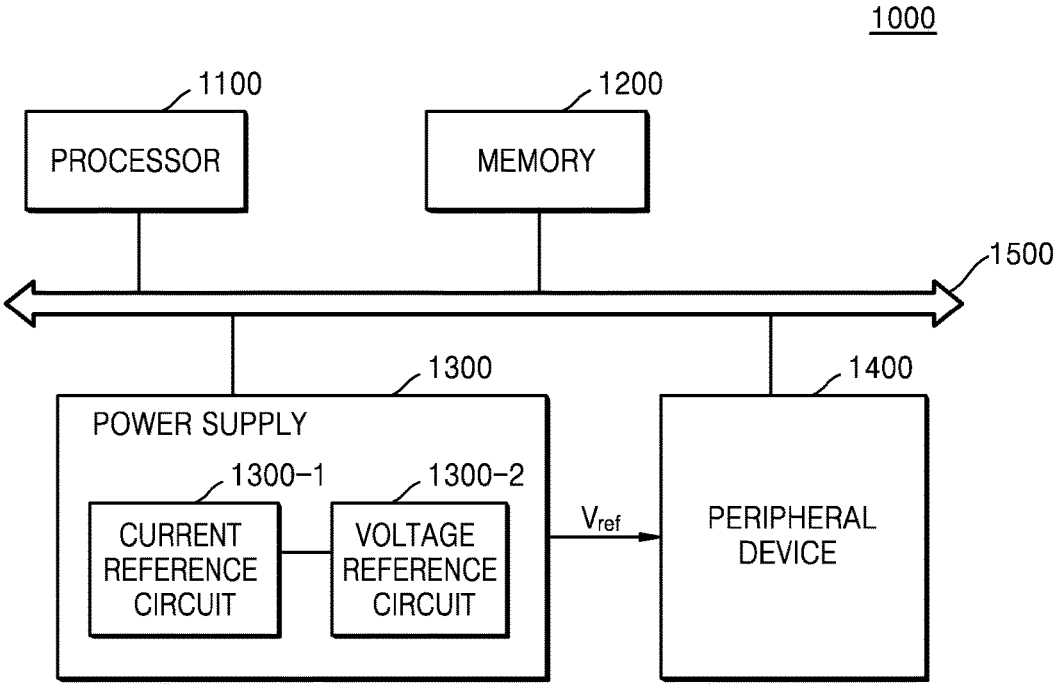
FIG. 14 illustrates a configuration of a semiconductor IC to which a current reference circuit according to embodiments of the inventive concept is applied.

FIG. 14 illustrates a configuration of a semiconductor IC 1000 to which a current reference circuit according to an embodiments of the inventive concept are applied.

Referring to FIG. 14, the semiconductor IC 1000 includes a processor 1100, a memory 1200, a power supply 1300, a peripheral device 1400, and a bus 1500.

Although not shown in FIG. 14, the semiconductor IC 1000 may further include a plurality of ports that communicate with a video card, a sound card, a memory card, and a universal serial bus (USB) device or communicate with other electronic devices.

The bus 1500 may denote a transmission path for transmitting data, a command, an address, and control signals between the elements of the semiconductor IC 1000.

The processor 1100 may perform certain calculations or tasks. For example, the processor 1100 may be a microprocessor or a central processing unit (CPU). The processor 1100 may control the memory 1200, the power supply 1300, and the peripheral device 1400 through the bus 1500 such as an address bus, a control bus, a data bus, or the like. In other embodiments, the processor 1100 may be connected to an extension bus such as a peripheral component interconnect (PCI) bus.

The memory 1200 may be implemented as a dynamic random access memory (DRAM) or a static random access memory (SRAM). As another example, the memory 1200 may be implemented as a nonvolatile memory. The memory 1200 may store data, commands, or program codes necessary for an operation of the semiconductor IC 1000.

The power supply 1300 includes a current reference circuit 1300-1 and a voltage reference circuit 1300-2. The current reference circuit 1300-1 may use the current reference circuits 100A, 100B, 100B' or 100B" illustrated in FIGS. 1 to 5. Therefore, the current reference circuit 1300-1 may generate a reference current having characteristic insensitive to a temperature. Also, the voltage reference circuit 1300-2 may use the voltage reference circuit 200 illustrated in FIG. 11.

The peripheral device 1400 may include an input/output device, an auxiliary memory device, an external memory device, and/or the like controlled by the processor 1100. For example, the peripheral device 1400 may include a memory device, a display device, a mobile terminal, a personal digital assistant (PDA), a camera, and/or the like. An internal circuit of the peripheral device 1400 may operate with a reference voltage $V_{ref}$ applied from the power supply 1300. For example, the peripheral device 1300 may generate various operating voltages by using the voltage regulator circuit illustrated in FIG. 12.

While the inventive concept has been particularly shown and described with reference to embodiments thereof, it will be understood that various changes in form and details may be made therein without departing from the spirit and scope of the following claims.

What is claimed is:

1. A current reference circuit comprising:

a current generator including an amplifier, a first transistor, a second transistor, a third transistor, a fourth transistor and a fifth transistor; and a current subtractor including a sixth transistor and a seventh transistor, wherein a first input terminal of the amplifier is connected to a first node that is connected to the first transistor, a second input terminal of the amplifier is connected to a second node that is connected to the second transistor, an output terminal of the amplifier is connected to a third node that is connected to a gate of the first transistor and a gate of the second transistor, the amplifier amplifies a voltage difference between the first node and the second node, and supplies an output voltage to the third node, the fourth transistor is connected to a resistor, and the resistor is connected to the first node, the fifth transistor is connected to the second node and to the sixth transistor, the first transistor, the second transistor and the third transistor form a first current mirror circuit and are controlled by the output voltage of the amplifier, a first current is applied to the current subtractor through the third transistor, and the third transistor is connected to the third node, the first current being proportional to a temperature, the current subtractor generates a second current that flows through the sixth transistor based on a third current that flows through the second transistor, and generates a reference current by subtracting the second current from the first current, the reference current that flows through the seventh transistor is insensitive to the temperature, and the fifth transistor and the sixth transistor form a second current mirror circuit.

2. The current reference circuit of claim 1, wherein the first current, the second current and the third current have a same temperature change rate, and the second current has a level that is different than a level of the first current and a level of the third current.

3. The current reference circuit of claim 1, wherein the first current increases in proportion to a change in an absolute temperature.

4. The current reference circuit of claim 1, wherein an aspect ratio of the fifth transistor is different from an aspect ratio of the sixth transistor.

5. The current reference circuit of claim 1, wherein a channel length of the sixth transistor is shorter than a channel length of the fifth transistor.

6. A current reference circuit comprising:

a current generator including an amplifier and a plurality of transistors that include a first transistor, a second transistor and a third transistor; and a current subtractor including a fourth transistor and a fifth transistor, wherein a first input terminal of the amplifier is connected to a first node that is connected to the first transistor, a second input terminal of the amplifier is connected to a second node that is connected to the second transistor, an output terminal of the amplifier is connected to a third node that is connected to the first transistor and the second transistor, the amplifier amplifies a voltage difference between the first node and the second node, and supplies an output voltage to the third node, a first current is applied to the current subtractor through the third transistor, and the third transistor is connected to the third node, the first current being proportional to a temperature, the current subtractor generates a second current that flows through the fourth transistor based on a third current that flows through the second transistor, and generates a reference current by subtracting the second current from the first current, the reference current that flows through the fifth transistor is insensitive to the temperature, and the current generator further includes a sixth transistor having a gate terminal and a drain terminal connected to a fourth node, and a resistor having a first terminal connected to the first node and a second terminal connected to the fourth node.

7. The current reference circuit of claim 6, wherein the plurality of transistors of the current generator further include a seventh transistor connected to the second node and to the fourth transistor.

8. The current reference circuit of claim 7, wherein the fourth transistor and the seventh transistor form a current mirror circuit.

9. The current reference circuit of claim 6, wherein the first current and the second current have a same temperature change rate, and have different levels.

10. The current reference circuit of claim 6, wherein the second current and the third current have a same temperature change rate, and have different levels.

11. The current reference circuit of claim 6, wherein the first current is the same as the third current.

12. The current reference circuit of claim 6, wherein the first transistor, the second transistor and the third transistor form a current mirror circuit and are controlled by the output voltage of the amplifier.

13. A current reference circuit comprising:

a current generator including a first branch circuit, a second branch circuit, an output branch circuit and an amplifier; and a current subtractor connected to the output branch circuit, wherein the current generator generates a first current that is applied to the current subtractor through the output branch circuit, the first current being proportional to a temperature, the current subtractor generates a second current based on a third current that flows in the second branch circuit of the current generator, and generates a reference current by subtracting the second current from the first current, the reference current is insensitive to the temperature, the amplifier amplifies a voltage difference between a node of a branch of the first branch circuit and a node of a branch of the second branch circuit, and supplies an output voltage to the first branch circuit and the second branch circuit, and the second branch circuit and the current subtractor are configured to include a current mirror circuit that generates the second current based on the third current.

14. The current reference circuit of claim 13, wherein the first current and the second current have a same temperature change rate, and have different levels.

15. The current reference circuit of claim 13, wherein a source voltage is supplied to the first branch circuit, the second branch circuit and the output branch circuit.

16. The current reference circuit of claim 13, wherein the first current increases in proportion to a change in an absolute temperature.

17. The current reference circuit of claim 13, wherein each of the first branch circuit and the second branch circuit includes one or more transistors.

18. The current reference circuit of claim 13, wherein transistors included in the first branch circuit, the second branch circuit and the output branch circuit are controlled in common by the output voltage of the amplifier.

19. The current reference circuit of claim 13, wherein the first current flows through the branch of the first branch circuit and the branch of the second branch circuit.

20. The current reference circuit of claim 13, wherein the third current is the same as the first current.

* * * * *